US007004101B1

(12) United States Patent
Mardikian

(10) Patent No.: US 7,004,101 B1
(45) Date of Patent: Feb. 28, 2006

(54) BOAT WITH STABILIZER ADAPTED TO SERVE AS LOADING PLATFORM

(75) Inventor: Albert Mardikian, Corona del Mar, CA (US)

(73) Assignee: The Mardikian Family Trust, Corona Del Mar, CA (US)

( * ) Notice: Subject to any disclaimer, the term of this patent is extended or adjusted under 35 U.S.C. 154(b) by 17 days.

(21) Appl. No.: 10/999,832

(22) Filed: Nov. 29, 2004

(51) Int. Cl.
*B63B 17/00* (2006.01)

(52) U.S. Cl. ..... 114/362

(58) Field of Classification Search ..... 114/60, 114/343, 362
See application file for complete search history.

(56) References Cited

U.S. PATENT DOCUMENTS 2,341,866 A * 2/1944 Higgins ..... 114/60
3,078,075 A * 2/1963 Richter ..... 114/60
4,907,673 A * 3/1990 Ginter et al. ..... 114/362
5,138,851 A 8/1992 Mardikia
5,367,978 A 11/1994 Mardikia
5,427,049 A 6/1995 Mardikia
5,465,679 A 11/1995 Mardikia
5,506,450 A 4/1996 Lee et al.
5,537,949 A * 7/1996 Blevins et al. ..... 114/362
5,622,132 A 4/1997 Mardikia
5,915,328 A * 6/1999 Rowan ..... 114/362
6,168,481 B1 1/2001 Mardikia
6,182,598 B1 * 2/2001 Bozzo ..... 114/362
6,343,964 B1 2/2002 Mardikia
6,620,003 B1 9/2003 Mardikia

* cited by examiner

*Primary Examiner*—Lars A. Olson
(74) *Attorney, Agent, or Firm*—Gabor L. Szekeres

(57) ABSTRACT

The hull of a boat includes an opening which is closed by a door attached to the hull with a hinge and capable of limited pivoting motion on the hinge with a substantially horizontal axis of the pivot. In its upright first extreme position the door comprises a part of the hull. In a second folded down extreme position the door is substantially parallel with the water surface and can act as a loading platform and also as a stabilizer against wave action in rough waters.

24 Claims, 7 Drawing Sheets

FIG. 4
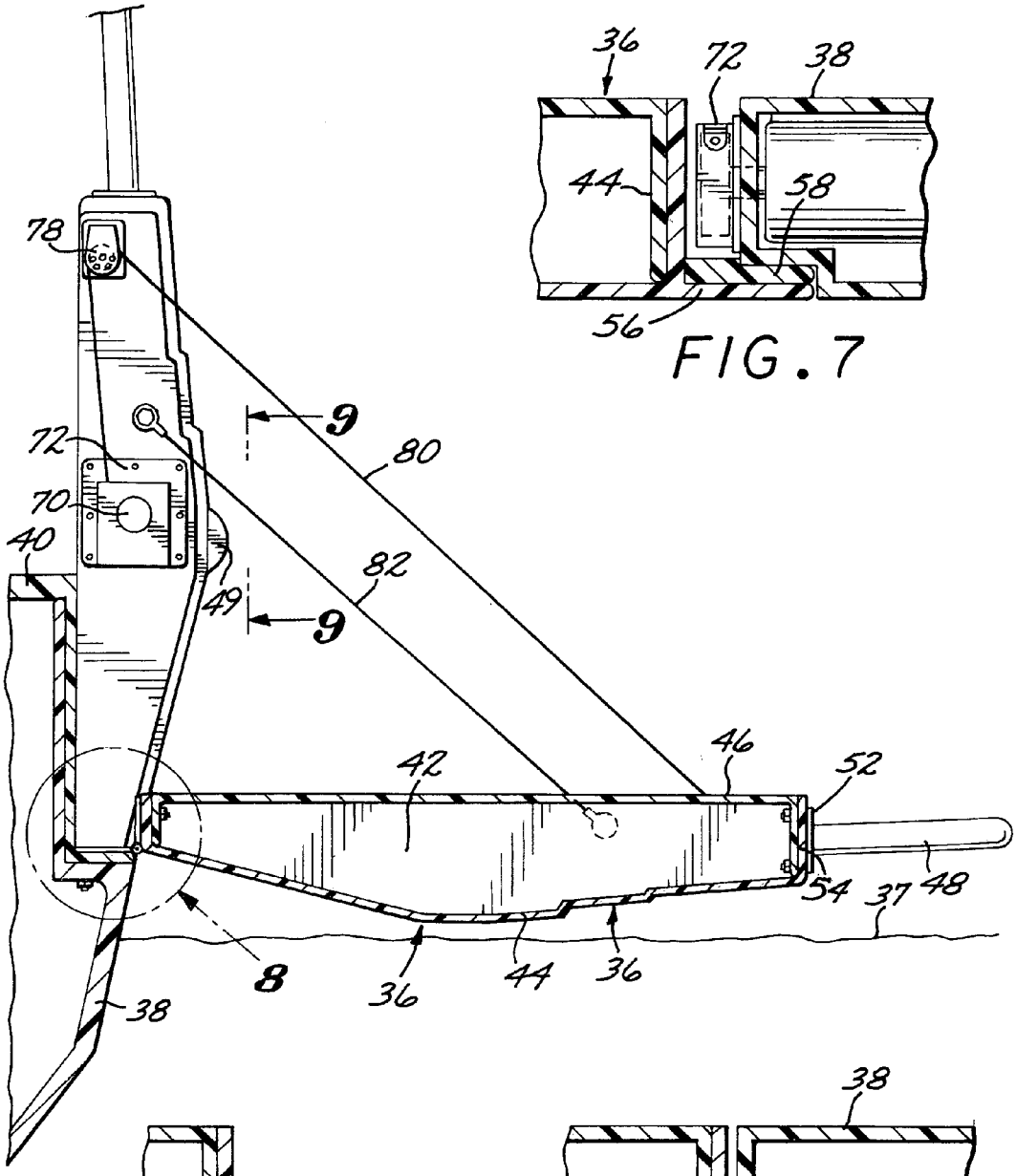
FIG. 7
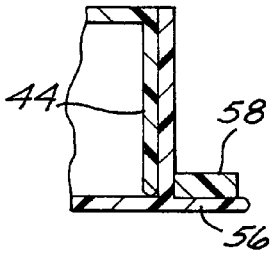
FIG. 5
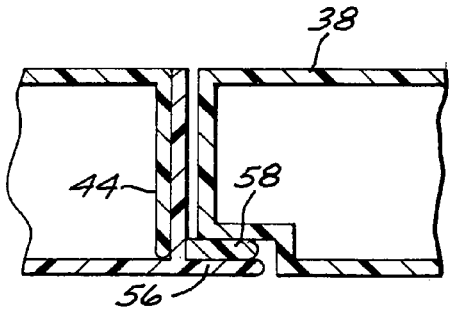
FIG. 6

FIG. 16
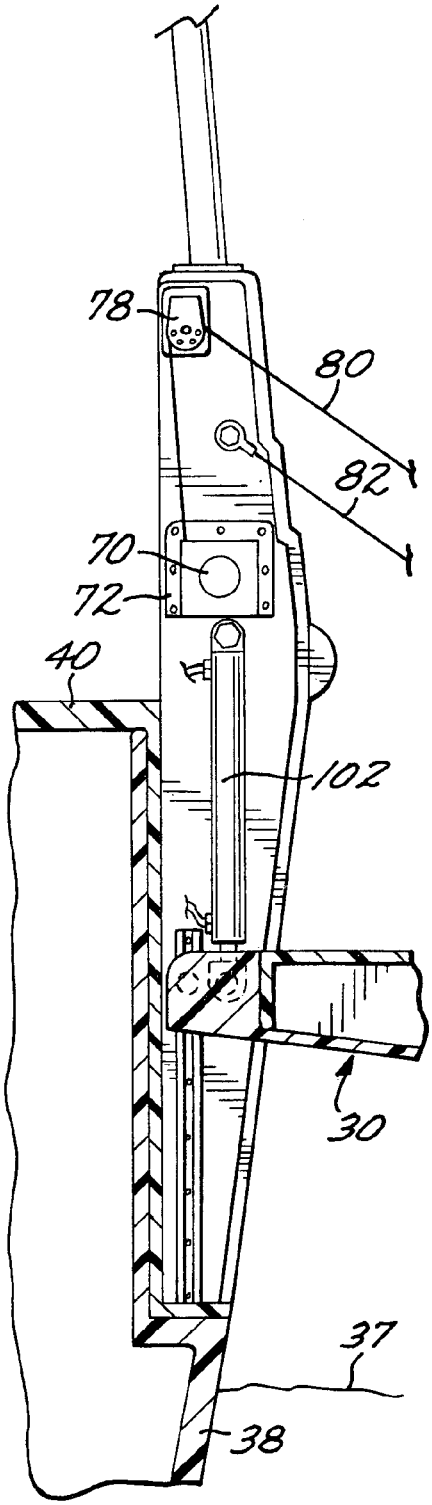
FIG. 17
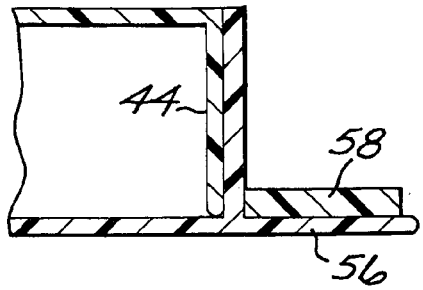
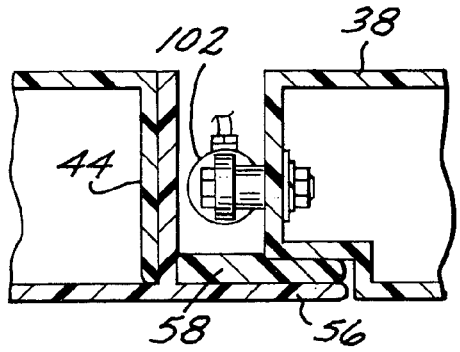
FIG. 18

BOAT WITH STABILIZER ADAPTED TO SERVE AS LOADING PLATFORM

BACKGROUND OF THE INVENTION

1. Field of the Invention

The present invention is directed to watercrafts or boats having a stabilizer which is also useable as a loading platform and door to enter the boat.

2. Brief Description of the Prior Art

Numerous patents are directed to boats or watercrafts. For example the following patents issued naming as inventor the inventor of the present application for patent: U.S. Pat. Nos. 5,506,450; 5,138,851; 5,309,861; 5,367,978; 5,465,679; 5,427,049; 5,622,132; and 6,620,003. U.S. Pat. Nos. 6,168,481 and 6,343,964 describe boats which are particularly adapted for rescue missions and fighting fires. The present invention discloses a boat or watercraft having stabilizers for preventing extensive rocking in rough waters and capable of being used as loading platforms and doors to enter the boat and as such represent a particularly significant improvement to fire fighting and rescue boats.

OBJECTS AND SUMMARY OF THE INVENTION

It is an object of the present invention to provide means on a boat or watercraft for serving as part of the hull and for serving as a loading platform and door through which persons or cargo can be removed from or loaded into the boat.

It is another object of the present invention to provide means on a boat or watercraft for serving as part of the hull and also for serving to stabilize the boat against excessive rocking in rough water and for serving as a loading platform through which persons or cargo can be removed from or loaded into the boat.

The foregoing and other objects are attained in accordance with the present invention by providing one or more hinged members in the hull which can be lowered to a position wherein the hinged member lies substantially on the water surface and serves as a loading platform. In another embodiment of the invention the hinged member is placed on a track whereby its vertical position relative to the hull is adjustable. The hinged members, when not in a fully upright position also serve as stabilizers against excessive rocking of the boat in rough waters.

BRIEF DESCRIPTION OF THE DRAWINGS

FIG. 4 is a cross-sectional view taken on lines 4,4 of FIG. 2.

FIG. 5 is a cross-sectional view taken on lines 5,5 of FIG. 2.

FIG. 6 is a cross-sectional view taken on lines 6,6 of FIG. 1.

FIG. 7 is a cross-sectional view similar to FIG. 6 and schematically showing a winch drive motor.

FIG. 16 is a cross-sectional view of a third preferred embodiment, the cross-section being taken similarly to the cross section shown in FIG. 2.

FIG. 17 is a cross-sectional view similar to FIG. 5 showing a modified version of the parts shown in FIG. 5.

FIG. 18 is a cross-sectional view similar to FIG. 6 showing a modified version of the parts shown in FIG. 6.

DESCRIPTION OF THE PREFERRED EMBODIMENTS

Figure 1:
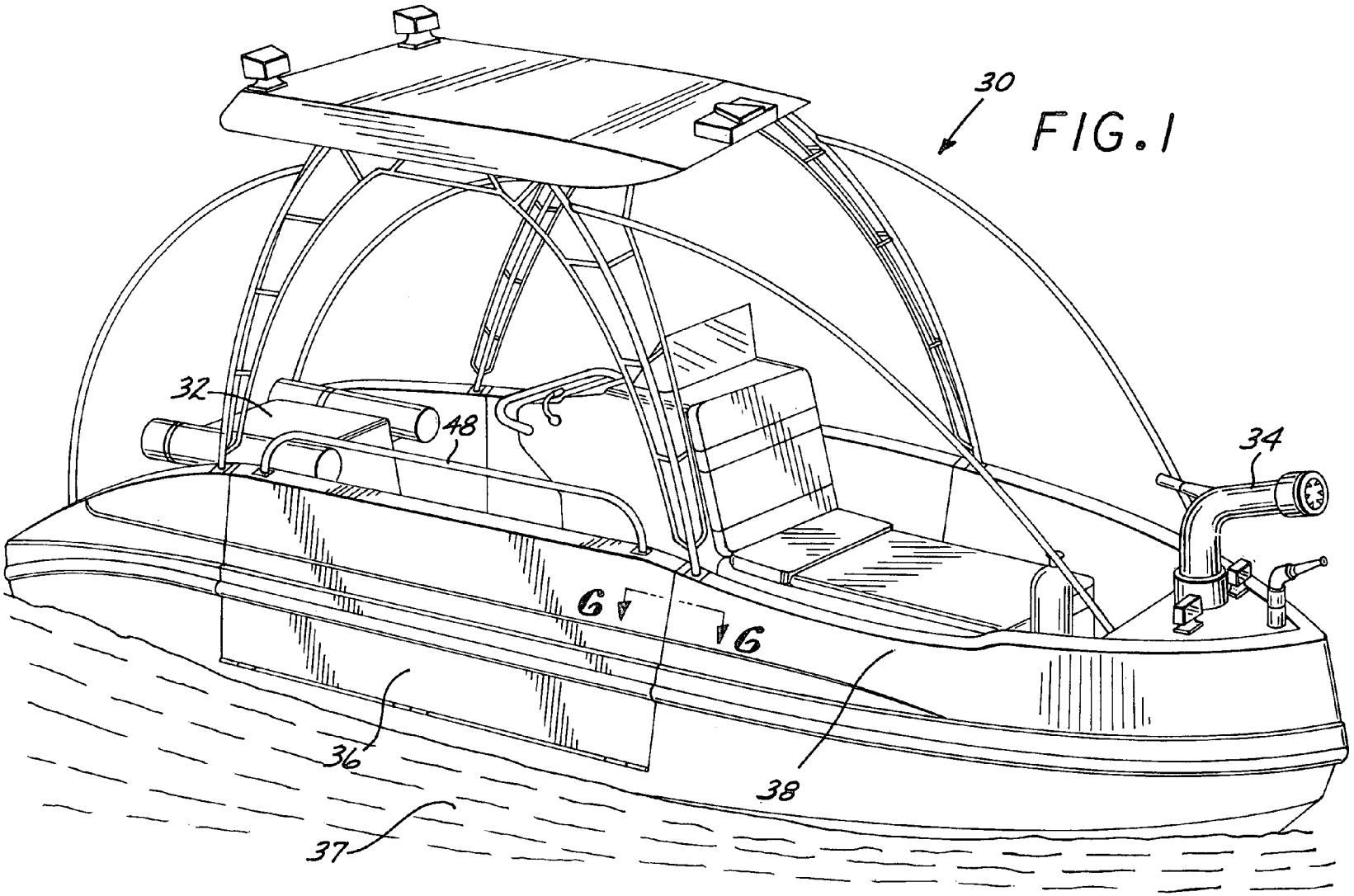
FIG. 1 is a perspective view of a boat or watercraft of the present invention showing a loading platform and stabilizer door in an upright closed position.

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

Referring now to the drawing figures, the novel boat or watercraft of the present invention is disclosed. It should be noted at the outset that the particular novel features of the boat or watercraft of the present invention comprise one or more loading platform and stabilizer doors, the dual purposes of which are to stabilize the boat against excessive rocking in rough waters and to provide a platform for facilitating loading and unloading of persons or cargo on the boat.

Whereas the novel platform and stabilizer doors can be included in a boat, vessel or watercraft of any size, the primary application of the novel platform and stabilizer doors is for rescue vessels which may or may not also be used for fighting fires. Rescue and fire fighting vessels of the type in which the platform and stabilizer doors of the present invention can be particularly advantageously incorporated are described in U.S. Pat. Nos. 6,168,481 and 6,343,964 the specifications of which are incorporated by reference. Such a fire fighting and rescue boat, including the novel features of the present invention is shown in FIG. 1 and bears the reference numeral 30.

The boat 30 includes a motive power source 32 which is schematically shown in the drawing figure, and a water monitor 34 from which water can be ejected under substantial pressure to fight fires. Another type of boat into which the platform and stabilizer doors of the present invention can be particularly advantageously incorporated is described in U.S. Pat. No. 6,168,481 the specification of which is incorporated by reference. However it should be noted that the present invention is limited neither by the type of boat or vessel in which it is incorporated, nor by the nature of the vessel's motive power source nor by the presence or absence of a fire-fighting water monitor.

One loading platform and stabilizer door 36 of the present invention is shown in the perspective view of FIG. 1. Although the present invention can be practiced by incorporating only one platform and stabilizer door 36 in the boat or vessel, preferably two or more platform and stabilizer doors 36 are incorporated in pairs, one or two or more on each side of the hull 38 and one or two or more on the other side.

Figure 2:
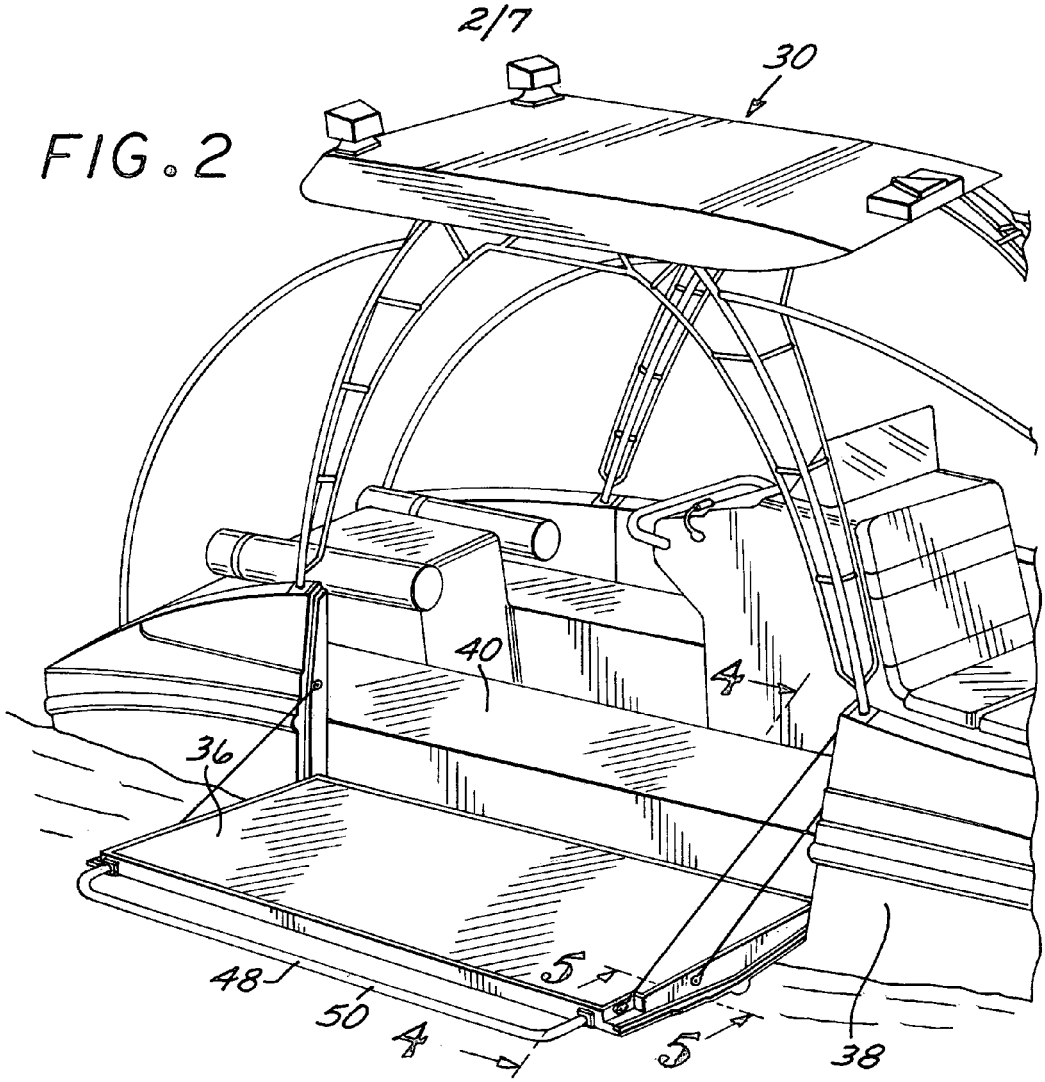
FIG. 2 is a perspective view of a first embodiment of the invention showing a loading platform and stabilizer door in a lowered position.
Figure 3:
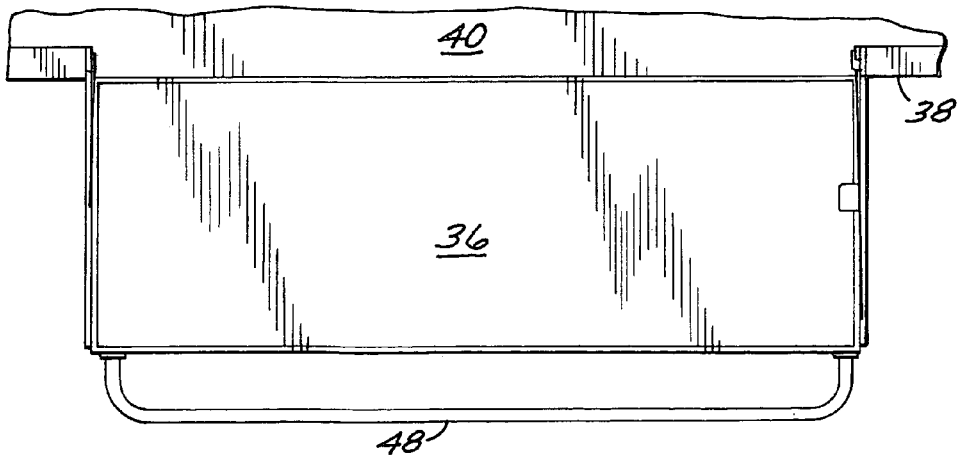
FIG. 3 is a partial top view of the embodiment shown in FIG. 2.

Referring now particularly to FIGS. 1 through 9, a first preferred embodiment of the boat having the novel platform and stabilizer doors 36, one on each side of the hull 38 is disclosed. In FIG. 2 the platform and stabilizer door 36 is in open, completely folded-down position in which the door 36 is basically parallel with the surface of the water 37 in which the boat or vessel 30 is located. The dimensions of the platform and stabilizer door 36 can be varied and the height of the fold-down position can be as low as the water's surface, or can be somewhat above the water surface, the main objective being that the door 36 should be able to act as a loading platform and a stabilizer against extensive rocking. On smaller boats, such as the fire extinguishing and rescue boat shown in FIG. 1, the folded-down door 36 is preferably at the water level 37 usually approximately level or slightly below the deck 40. On larger boats the folded-down door 36 in its lowest position is preferably 12 to 17 inches below the deck 40. However it should be understood that the foregoing dimensions are only exemplary and not limiting in nature.

How the folded-down door 36 is used as a loading platform should be apparent from an inspection of drawing figures. The ability of the folded-down door 36 to be used as a loading platform is especially advantageous in rescue missions for loading or unloading an injured person (not shown), particularly when the boat 30 is docked adjacent to a pier (not shown) or other vessel (not shown). The folded-down door 36 can also be used as a loading platform for persons, such as swimmers, snorklers or scuba-divers, to enter and exit from the water, or for placing into or retrieving objects from the water.

The door 36 when folded down as shown, for example, in FIG. 2, will also act as a stabilizer against extensive rocking caused by wave action. The stabilizing effect is particularly pronounced when two or more doors 36 of the boat or vessel 30 are folded down.

Referring still to FIGS. 1 through 9 and particularly to FIG. 4, the door 36 of the preferred embodiment is shown as a hollow body which is preferably filled with buoyant flotation foam 42 of the type well known in the art. The door 36 of the preferred embodiments is assembled from an outer 44 and an inner member 46 of highly reinforced fiberglass. The outer member 44 has a curved contour which substantially matches the shape of the hull 38. The inner member 46 is substantially flat. A railing 48 which comprises a handle piece 50 and a flat member 52, preferably of reinforced fiberglass, is attached to the top edge 54 of the door 36. The railing 48 is particularly useful for a person or persons (not shown) to hold on to when wishing to enter the boat 30 from the water.

FIG. 4 also shows a rub-rail 49 which is standard feature on most boats.

The detailed pictures of FIGS. 5 and 6 show a flange 56 included in the outer member 44 of the door 36. A compressible seal 58, comprising material or materials known in the art, is attached to the flange 56. FIG. 5 shows the flange 56 in open, folded-down position of the door 36 while FIG. 6 shows the flange 56 in the closed position of the door 36 substantially flush with hull 38 where the flange 56 and seal 58 act to protect the vessel from entry of water when the door 36 is in an upright position.

Figure 8:
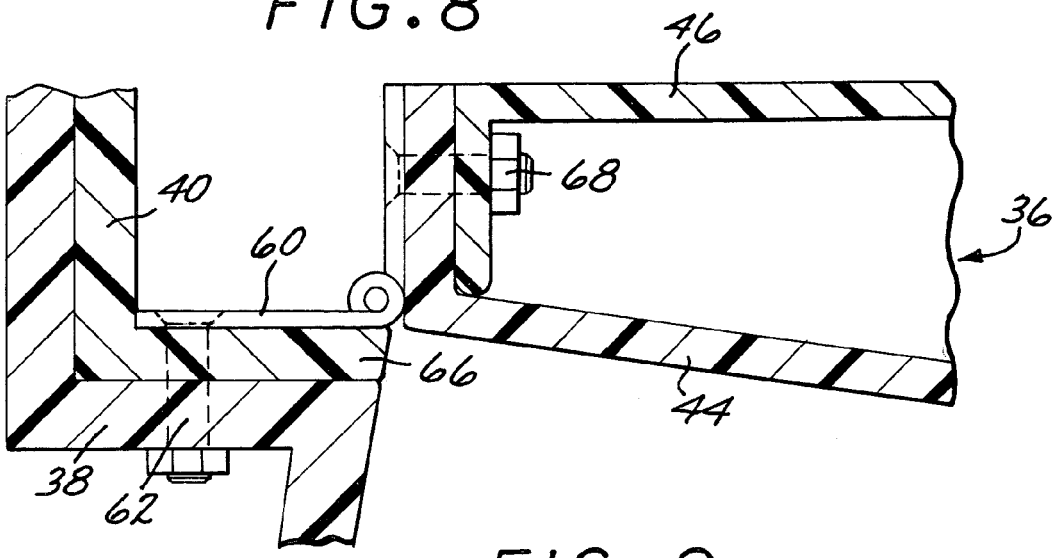
FIG. 8 is an enlarged view of the area indicated on FIG. 4, showing the attachment of a hinge to the hull and to the platform and stabilizer door.
Figure 9:
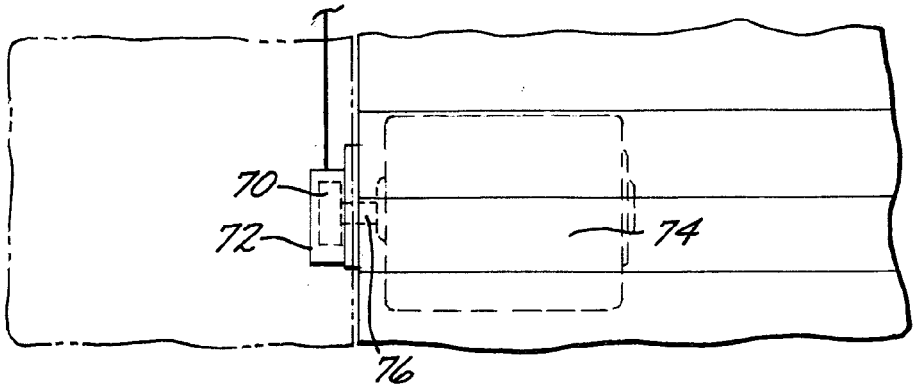
FIG. 9 is a plan view taken on lines 9,9 of FIG. 4, showing a winch motor with dotted lines.

The cross-sectional view of FIG. 4 and the detailed pictures of FIGS. 7 and 8 particularly show the assembly of the loading platform stabilizer door 36 to the hull 38 and the mechanism of the first preferred embodiment by which the door 36 is lowered into a folded-down or raised into a closed position.

A hinge 60 is attached by a bolt 62 to a stepped-out portion 64 of the hull 38 and to the overlying part 66 of the deck 40. The hinge 60 is also attached by a bolt 68 to the door 36. In FIG. 8 the door 36 is shown in a folded-down, open position where it can act as a stabilizer and loading platform. The door 36 is also shown in a lowered folded own position in FIG. 4. A sheave 70 positioned in a housing 72 and driven by an electric motor 74 is mounted to the hull 38. The motor 74 and a shaft 76 which drives the sheave 70 is shown by dotted lines in FIG. 9. A pulley 78 is also mounted to the hull 38 above the housing 72 of the sheave 70. A cable 80 is attached to the sheave 70, led over the pulley 78 and is attached to the door 36. Winding up the cable 80 on the sheave 70 when the sheave 70 is driven by the motor 74 raises the door 36 while unwinding the cable 80 lowers the door 36. In alternative embodiments not shown here the sheave 70, acting as a winch, can also be driven manually or hydraulically. A second cable 82 is attached to the hull 38 and to the door 36 and acts as a limiting cable for the unfolded, lowered position of the door 36.

The detailed view of FIG. 7 shows the how the winch comprising the housing 72 and the sheave 70 is mounted between the door 36 and the hull 38.

Figure 10:
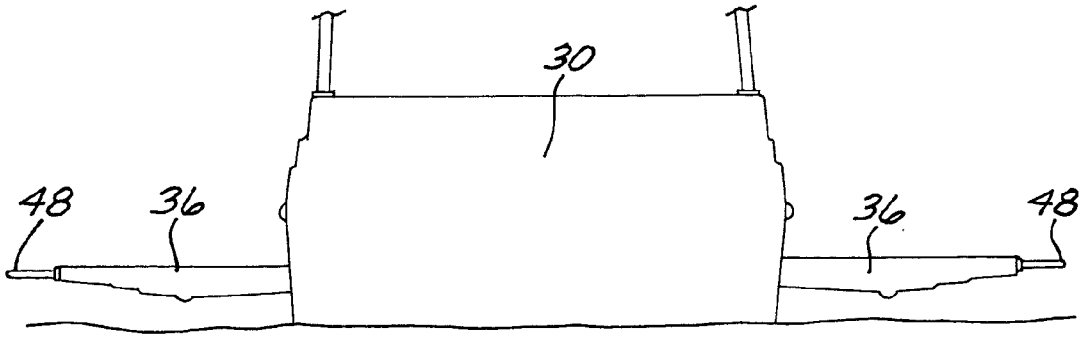
FIG. 10 is a schematic rear view of a boat having two loading platform and stabilizer doors.

The schematic view of FIG. 10 shows a boat 30 in accordance with the present invention, having two loading platform stabilizer doors 36 with each door 36 being in a folded-down, lowered position.

Figure 11:
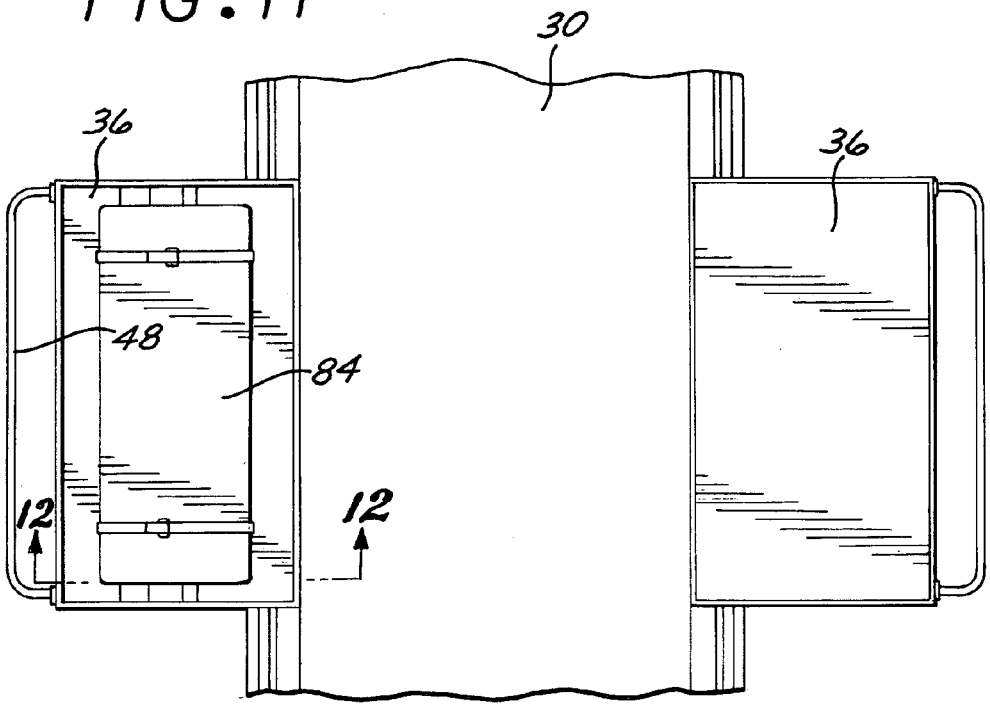
FIG. 11 is a schematic top plan view of a boat having two loading platform and stabilizer doors, one of said stabilizer doors being equipped with a stretcher for rescue of an injured person.
Figure 12:
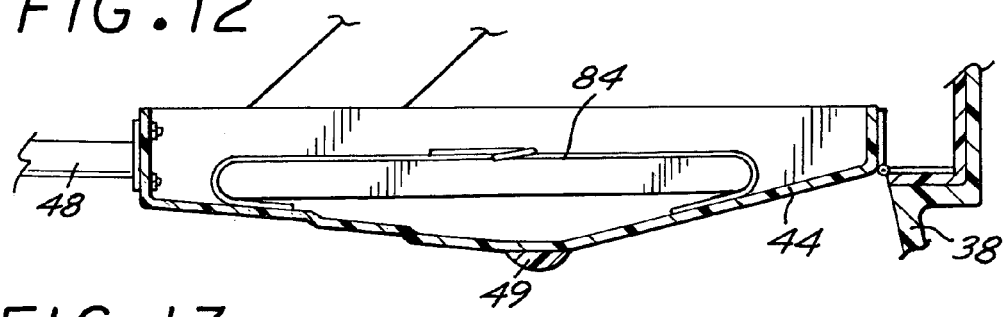
FIG. 12 is a cross-sectional view taken on lines 12,12 of FIG. 11.

The schematic views of FIGS. 11 and 12 disclose another embodiment having two doors 36 in folded-down, lowered position. The door 36 shown on the left, port side of the boat 30 lacks an inner member 46. Instead a stretcher 84 is removably attached into the hollow interior of the outer member 44. the stretcher 84 is useful in rescue missions particularly when an injured person (not shown) needs to be taken off the boat 30.

Figure 13:
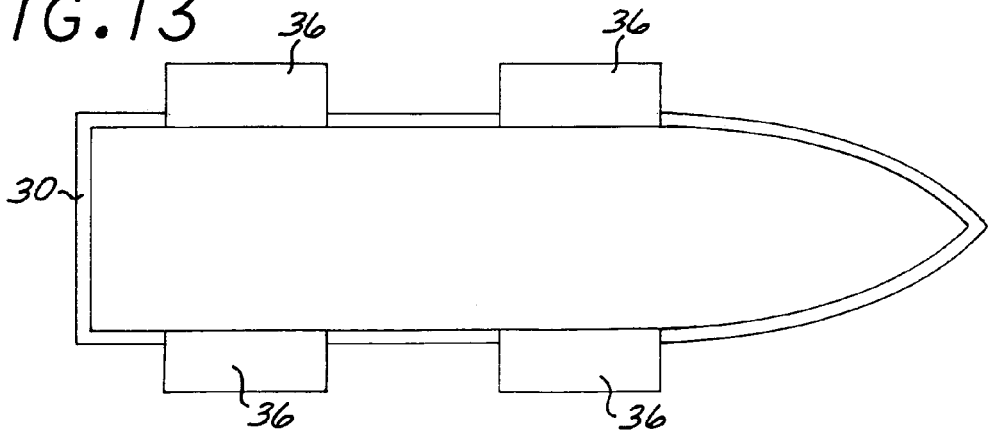
FIG. 13 is a schematic top plan view of a boat having four loading platform and stabilizer doors.
Figure 15:
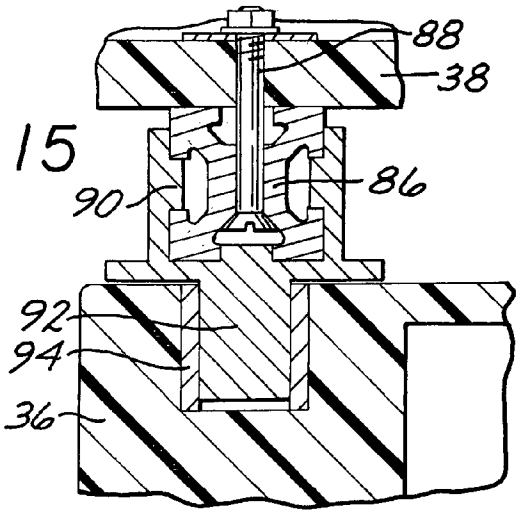
FIG. 15 is a cross-sectional view of the second preferred embodiment, the cross-section taken on lines 15,15 of FIG. 14.

FIG. 13 schematically shows a boat 30 in accordance with the present invention having four stabilezer and loading platform doors 36, each in a folded-down, lowered position. It should be noted that the number of doors 36 opened and folded down can be decided in accordance with the judgment of the person or presons (not shown) who operate the boat 30 and depend on the need for loading platforms and/or for stabilizing action in rough waters.

FIGS. 14 through 18 disclose a second preferred embodiment of the boat 30 having one or more stabilezer and loading platform doors. In this embodiment the difference between the level of the deck 40 and the water line 37 is substantial, and the stabilizer and loading platform door 36 is mounted in such a manner that it can be disposed in a range of lowered down positions relative to the deck 40 and the water line 37. This is accomplished by providing a track 86 which is attached by bolts 88 to the hull 38. A substantially U-shaped member 90 moves on the track 86 and includes an extending cylindrical portion 92 which acts as a pivot axle or pivot pin for the door 36. A bushing 94 is placed between the pivot axle 92 and the door 36.

Figure 14:
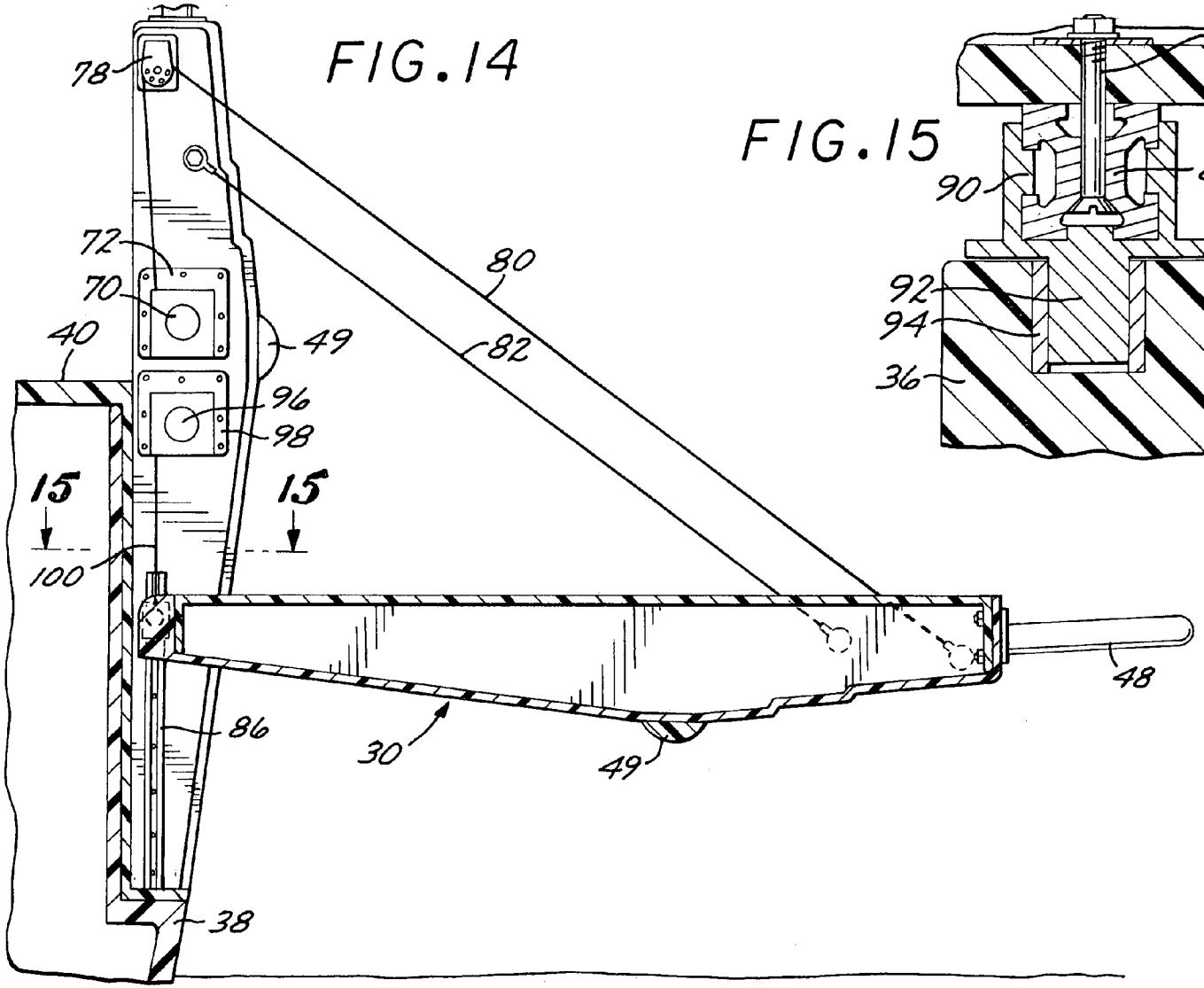
FIG. 14 is a cross-sectional view of a second preferred embodiment, the cross-section being similar to the cross section shown in FIG. 2.

Referring now particularly to FIG. 14, the second preferred embodiment has two winches mounted to the hull, The first of the two winches includes a sheave 70 in a housing 72 and has the door-opening and closing cable 80 affixed to it. This winch operates in substantially the same manner as the winch of the first preferred embodiment. A second winch having another sheave 96 in a housing 98 winds a cable 100 which lowers or raises the door 36 in its open folded-down position. The second winch, similarly to the first winch, is preferably operated by an electric motor (not shown) although manual operation of the winch is also possible. The detailed view of FIG. 17 shows that a larger flange 56 and seal 58 are utilized in the second preferred embodiment than in the first preferred embodiment.

FIG. 16 discloses a variation of the second preferred embodiment where a hydraulic mechanism 102, well known in the art per se, is utilized for lowering and raising the door 36 in its folded down position.

A significant advantage of the second preferred embodiment lies in the adjustability of the level of the folded-down door 36 relative to the water's surface 37 and the deck 40. This feature improves the ability of the folded-down door or doors 36 to act as stabilizer in rough waters and also enables the the optimal adjustment of the level of the folded-down door for loading and unloading persons and items from the boat 30.

Still further variations of constructing a boats with the stabilezer, loading platform door assembly of the present invention may become readily apparent to those skilled in the art in accordance with the present disclosure. Therefore the scope of the present invention should be determined solely from the following claims, as such claims are interpreted in light of the disclosure and the relevant law and prior art.

The invention claimed is:

1. A boat comprising:

a hull having an opening for placement of a door;

power means for moving the boat in water;

a deck;

a door disposed in the opening of the hull in an upright position wherein it serves as part of the hull, said door being attached to the hull with a hinge that enables the door to be folded downward on a substantially horizontal axis, and means for allowing the door to be folded downward whereby the door may occupy a second position basically parallel with the surface of the water in which the boat may float, said second position being flexible relative to the deck whereby the door in its second position can pivot up and down relative to the deck in response to wave action, said means being also adapted for returning the door to the upright position whereby the door in its folded down position is capable of acting as a stabilizer for the boat against wave action and of serving as a loading platform.

2. A boat in accordance with claim 1 having a plurality of openings for placement of one door in each opening, a plurality of doors each of which is disposed on one opening, is attached to the hull with a hinge that enables the door to be folded downward on a substantially horizontal axis, and means for allowing each door to be folded downward whereby each door may occupy the second position substantially parallel with the surface of the water in which the boat may float, said second positions being flexible relative to the deck whereby the doors in their second positions can pivot up and down relative to the deck in response to wave action, said means being also adapted for returning each door to the upright position whereby each door in its folded down position is capable of acting as a stabilizer for the boat against wave action and of serving as a loading platform.

3. A boat in accordance with claim 1 wherein the means comprises a winch and a cable mechanism.

4. A boat in accordance with claim 1 additionally comprising limiting cable means for limiting downward folding of the door beyond a predetermined angle relative to the deck.

5. A boat comprising:

a hull having an opening for placement of a door;

power means for moving the boat in water;

a deck;

a door disposed in the opening of the hull in an upright position wherein it serves as part of the hull said door being attached to the hull with a hinge that enables the door to be folded downward on a substantially horizontal axis, and means for allowing the door to be folded downward whereby the door may occupy a position basically parallel with the surface of the water in which the boat may float, said means being also adapted for returning the door to the upright position whereby the door in its folded down position is capable of acting as a stabilizer for the boat against wave action and of serving as a loading platform the hinge being located below the level of the deck.

6. A boat comprising:

a hull having an opening for placement of a door;

power means for moving the boat in water;

a deck;

a door disposed in the opening of the hull in an upright position wherein it serves as part of the hull said door being attached to the hull with a hinge that enables the door to be folded downward on a substantially horizontal axis;

means for allowing the door to be folded downward whereby the door may occupy a position basically parallel with the surface of the water in which the boat may float said means being also adapted for returning the door to the upright position whereby the door in its folded down position is capable of acting as a stabilizer for the boat against wave action and of serving as a loading platform, and further comprising means for moving the door up and down relative to the level of the deck, at the option of an operator, when said door is in a folded down position.

7. A boat in accordance with claim 6 wherein the means for moving the door up and down comprises a winch and a cable mechanism.

8. A boat in accordance with claim 7 wherein the means for moving the door up and down comprises a hydraulic mechanism.

9. A boat comprising:

a hull having an opening for placement of a door, said hull having a stepped out portion in the area of said opening;

power means for moving the boat in water;

a deck;

a hinge having a nominally horizontal axis and being attached to the stepped out portion of the hull;

a door attached to the hinge, said door being capable of a first extreme position wherein it is upright and closes the opening in the hull, and a second extreme position wherein the door is folded down in a nominally horizontal position thereby creating an opening in the hull;

means for lowering the door from the first extreme position to the second extreme position whereby the door in its second extreme position is capable of acting as a stabilizer for the boat against wave action and of serving as a loading platform said second extreme position being flexible relative to the deck whereby the door in its second position can pivot up and down relative to the deck in response to wave action.

10. A boat in accordance with claim 9 wherein the means for lowering the door comprise a winch attached to the hull, a cable attached to and capable of being wound on the winch, said cable also being attached to the door.

11. A boat in accordance with claim 10 further comprising a limiting cable attached to the hull and attached to the door whereby the door is prevented of pivoting farther than the second extreme position.

12. A boat in accordance with claim 9 wherein the means for lowering the door from the first extreme position to the second extreme position is driven by electric power.

13. A boat comprising:

a hull having an opening for placement of a door; said hull having a stepped out portion in the area of said opening;

power means for moving the boat in water;

a deck;

a hinge having a nominally horizontal axis and being attached to the stepped out portion of the hull;

a door attached to the hinge, said door being capable of a first extreme position wherein it is upright and closes the opening in the hull, and a second extreme position wherein the door is folded down in a nominally horizontal position thereby creating an opening in the hull;

means for lowering the door from the first extreme position to the second extreme position whereby the door in its second extreme position is capable of acting as a stabilizer for the boat against wave action and of serving as a loading platform and means for moving the door up and down relative to the level of the deck, at the option of an operator, when said door is in its second extreme position.

14. A boat in accordance with claim 13 wherein the means for moving the door up and down comprises a winch and a cable mechanism.

15. A boat in accordance with claim 13 wherein the means for moving the door up and down comprises a hydraulic mechanism.

16. A boat in accordance with claim 13 wherein the means for moving the door up and down is driven by electric power.

17. In a boat having a hull, power means for moving the boat in water and a deck, the improvement comprising:

a door placed into an opening in the hull;

the hull having a stepped out portion in the area of said opening a hinge having a nominally horizontal axis and being attached to the stepped out portion of the hull, said door being attached to the hinge and capable of a first extreme position wherein it is upright and closes the opening in the hull, and a second extreme position wherein the door is folded down in a nominally horizontal position thereby creating an opening in the hull;

means for lowering the door from the first extreme position to the second extreme position whereby the door in its second extreme position is capable of acting as a stabilizer for the boat against wave action and of serving as a loading platform said second extreme position being flexible relative to the deck whereby the door in its second position can pivot up and down relative to the deck in response to wave action.

18. The improvement in accordance with claim 17 wherein the means for lowering the door comprise a winch attached to the hull, a cable attached to and capable of being wound on the winch, said cable also being attached to the door.

19. The improvement in accordance with claim 18 further comprising a limiting cable attached to the hull and attached to the door whereby the door is prevented of pivoting farther than the second extreme position.

20. The improvement in accordance with claim 18 wherein the means for lowering the door from the first extreme position to the second extreme position is driven by electric power.

21. In a boat having a hull, power means for moving the boat in water and a deck the improvement comprising:

a door placed into an opening in the hull;

the hull having a stepped out portion in the area of said opening a hinge having a nominally horizontal axis and being attached to the stepped out portion of the hull said door being attached to the hinge and capable of a first extreme position wherein it is upright and closes the opening in the hull; and a second extreme position wherein the door is folded down in a nominally horizontal position thereby creating an opening in the hull;

means for lowering the door from the first extreme position to the second extreme position whereby the door in its second extreme position is capable of acting as a stabilizer for the boat against wave action and of serving as a loading platform; said means for lowering the door comprising a winch attached to the hull a cable attached to and capable of being wound on the winch; said cable also being attached to the door, and means for moving the door up and down relative to the level of the deck at the option of an operator when said door is in its second extreme position.

22. The improvement in accordance with claim 21 wherein the means for moving the door up and down comprises a winch and a cable mechanism.

23. The improvement in accordance with claim 21 wherein the means for moving the door up and down comprises a hydraulic mechanism.

24. A boat in accordance with claim 21 wherein the means for moving the door up and down is driven by electric power.

* * * * *